United States Patent [19]

Deinlein-Kalb

[11] 4,019,713

[45] Apr. 26, 1977

[54] RAPID SHUTOFF EXTRACTION CHECK VALVE

[75] Inventor: Hans Deinlein-Kalb, Nurnberg, Germany

[73] Assignee: AEG-Kanis Turbinenfabrik GmbH, Nurnberg, Germany

[22] Filed: July 22, 1975

[21] Appl. No.: 598,024

[30] Foreign Application Priority Data

July 25, 1974 Germany ..... 2435728

[52] U.S. Cl. ..... 251/28; 251/63.4

[51] Int. Cl.[2] ..... F16K 31/122

[58] Field of Search ..... 92/85 R, 113; 251/25, 251/26, 28, 29, 77, 82, 63.4

[56] References Cited

UNITED STATES PATENTS

| | | | |
|---|---|---|---|
| 723,025 | 3/1903 | Resor | 92/85 R |
| 862,867 | 8/1907 | Eggleston | 251/61 |
| 2,377,227 | 5/1945 | Griswold | 251/25 |
| 2,417,994 | 3/1947 | Sheets | 251/26 |
| 2,445,163 | 7/1948 | Williamson | 251/25 |
| 2,661,023 | 12/1953 | Griswold | 251/28 |
| 2,744,719 | 5/1956 | McRae | 251/25 |
| 2,789,510 | 4/1957 | Meynig | 92/113 |
| 2,841,359 | 7/1958 | Berck | 251/25 |
| 3,101,924 | 8/1963 | Berck | 251/25 |

FOREIGN PATENTS OR APPLICATIONS

| | | | |
|---|---|---|---|
| 847,211 | 6/1952 | Germany | 251/25 |

*Primary Examiner*—Martin P. Schwadron
*Assistant Examiner*—G. L. Walton
*Attorney, Agent, or Firm*—Spencer & Kaye

[57] ABSTRACT

A rapid shutoff extraction check valve has a movable valve body cooperating with a valve seat that divides a valve housing into an upstream housing chamber communicating with the valve inlet and a downstream housing chamber communicating with the valve outlet. The movable valve body is displaceably supported by an actuating piston which is slidably received in a guide cylinder enclosing a pressure chamber. The actuating piston has a radial face exposed to pressure in the downstream housing chamber. An auxiliary valve forming part of the rapid shutoff check valve has a first position in which communication is maintained between one housing chamber and the pressure chamber and a second position in which the pressure chamber is vented. In the first position of the auxiliary valve the actuating piston exerts a closing force on the movable valve body.

8 Claims, 2 Drawing Figures

RAPID SHUTOFF EXTRACTION CHECK VALVE

BACKGROUND OF THE INVENTION

This invention relates to a fluid pressure-operated, rapid shutoff extraction check valve for gas and steam turbines. The function of such a valve is to permit, by an automatic opening, steam transmission to the steam consumers after the pressure required by the steam consumers has been reached at the extraction point of the turbine and to protect the turbo-assembly during operation from disturbances originating in the consumer network.

The valve is to prevent impermissible temperature changes in the turbine caused by the backflowing steam, the condition of which differs from that at the extraction point of the turbine. A further function of the valve is to prevent the backflowing steam — for example as a result of a condensate exhaust in feedwater preheaters upon pressure decrease — from causing an impermissible rpm increase upon separation of the turbo-assembly from the network and to prevent water from being admitted to the turbine upon impermissible increase of the water level in the preheater.

SUMMARY OF THE INVENTION

It is an object of the invention to provide an improved valve of the afore-outlined type which is devoid of mechanical rod linkages and pawl assemblies; which has no movable valve components that are sealed with respect to the atmosphere so as to securely prevent deposits from the pressure medium on these components.

These objects and others to become apparent as the specification progresses, are accomplished by the invention, according to which, briefly stated, the rapid shutoff extraction check valve has a movable valve body cooperating with a valve seat that divides a valve housing into an upstream housing chamber communicating with the valve inlet and a downstream housing chamber communicating with the valve outlet. The movable valve body is displaceably supported by an actuating piston which is slidably received in a guide cylinder enclosing a pressure chamber. The actuating piston has a radial face exposed to pressure in the downstream housing chamber. An auxiliary valve forming part of the rapid shutoff extraction check valve has a first position in which communication is maintained between one housing chamber and the pressure chamber and a second position in which the pressure chamber is vented. In the first position of the auxiliary valve the actuating piston exerts a closing force on the movable valve body.

DESCRIPTION OF THE PREFERRED EMBODIMENTS

Figure 1:
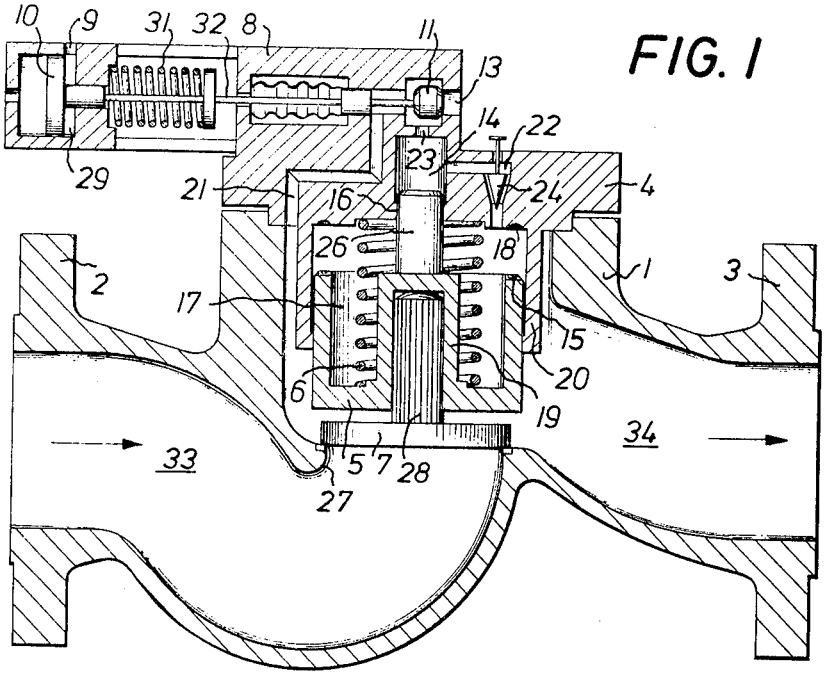
FIG. 1 is an axial sectional view of a preferred embodiment of the invention.

Turning now to FIG. 1, the valve assembly comprises a valve housing part 1 having an inlet flange 2 (main inlet) and an outlet flange 3 (main outlet). The valve structure proper is accommodated in a valve block 4 which is mounted in an opening in the valve housing part 1 between the inlet 2 and the outlet 3 and which is also part of the valve housing. In the valve block 4 there is formed a guide cylinder 20 in which there is received, in a fluid tight sliding fit, a reciprocating actuating piston 5. The actuating piston 5 and the cylinder 20 defines a pressure chamber 17 in which there is disposed a compression spring 6 continuously urging the valve piston 5 outwardly of the cylinder 20. In the valve block 4 there is further formed a spindle chamber 14 which slidably receives a spindle 26 constituted by an axial extension of the actuating piston 5. A clearance 16 is provided along the spindle 26 to maintain communication between the spindle chamber 14 and the cylinder chamber 17. The actuating piston 5 has, within the cylinder chamber 17, a radial annular sealing face 15 which, when the actuating piston 5 is pushed entirely inwardly, provides a metal seal in cooperation with an annular face 18 forming part of a wall of the cylinder chamber 17. The actuating piston 5 is provided with an outwardly open socket 19 for receiving and guiding a stem 28 affixed to a valve disc 7. The valve disc 7 cooperates with a valve seat 27 defined by walls of the housing 1 between the inlet 2 and the outlet 3.

The valve seat 27 divides the inner space of the valve housing into an upstream housing chamber 33 communicating with the valve inlet 2 and a downstream housing chamber 34 communicating with the valve outlet 3.

In the valve block 4 there is further arranged a three-way auxiliary valve 8 which is essentially formed of a setting piston 10 received in a pressure chamber 29, a valve head 11 connected with the setting piston 10 by means of a stem 32, and a compression spring 31 urging the setting piston 10 to reduce the volume of the pressure chamber 29 and, at the same time, to urge the valve head 11 into a position in which it closes a discharge outlet 13. Pressurized fluid may be introduced into and withdrawn from the pressure chamber 29 through a port 9. With the discharge outlet 13 which is controlled by the valve head 11, there communicates a channel 21 which leads to the downstream housing chamber 34 and a port 23 which, in turn, leads to the spindle chamber 14. From the spindle chamber 14 there extends a further channel 22 which opens into the cylinder chamber 17 and which is controlled by an adjustable throttle 24.

The rapid shutoff extraction check valve described above is hydraulically inserted in the safety circuit of the turbine. The "standby-for-opening" state of the valve assembly is brought about by introducing pressurized fluid (preferably rapid action-responsive hydraulic oil) through the port 9 into the pressure chamber 29 of the auxiliary valve 8 when a predetermined minimum output of the turbo-assembly is exceeded. As a result, the setting piston 10 and the valve head 11 are moved against the force of the spring 31 into the starting position (towards the left, as viewed in FIG. 1). Upon this occurrence — with a simultaneous closing of the channel 21 — the discharge outlet 13 is opened and the steam pressure in the spindle chamber 14 is reduced (the pressurized steam was previously introduced into the spindle chamber 14 from the consumer network through the valve outlet 3). As a result, the pressure force exerted on the outer radial face of the actuating piston 5 overcomes the biasing force of the closing spring 6 and the actuating piston 5 is moved upwardly until, with its sealing face 15 it tightly engages the seat-like stop 18 of the radial base wall of the cylinder chamber 17. The fluid medium still enclosed in the chamber 17 may now entirely flow out through the clearance 16 and the outlet 13, so that in the operational standby stage and during operation no leakage steam has to be taken to the outside.

Figure 2:
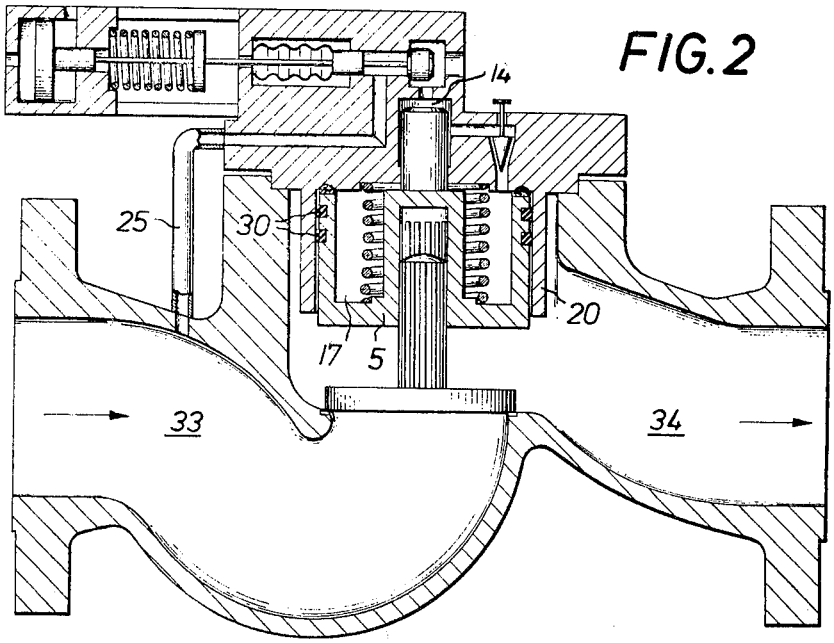
FIG. 2 is an axial sectional view of another preferred embodiment of the invention.

If now a difference between the pressure in the upstream housing chamber 33 and the pressure in the downstream housing chamber 34 exceeds the weight of the valve disc 7, the latter will execute an opening motion, that is, it will lift off its seat 27. The pressure forces required to overcome the weight of the movable valve disc 7 remain approximately constant throughout the entire stroke of the valve disc 7 and are regulated by the valve disc itself which sets the flow passage opening and thus throttles the fluid medium. In operation, the valve stroke is, for example, proportionate to the steam consumption of the consuming network and will equal zero if the consumer stops steam consumption or in case there is a steam inflow into the consuming network from a second feed source (reducing station). In case on the consuming side (communicating with the downstream housing chamber 34) for some reason there is set a higher steam pressure that at the extraction point of the turbine, the valve disc 7 effects — as a check valve — a fluid-tight seal towards the turbine. It is thus seen that when the actuating piston 5 is in its upper, withdrawn position as shown in FIG. 2, the valve disc 7 acts as a mechanically freely movable check valve which is opened or closed solely by the pressure conditions in the upstream and downstream housing chambers 33 and 34, respectively.

Upon triggering a rapid turbine shutoff and an oil pressure drop in the pressure chamber 29, the valve head 11 is switched to its closing position (that is, towards the right, as viewed in FIG. 1) by the force of the spring 31 and, as a result, the valve outlet 13 is shut off and the channel 21 is opened. In this manner, the spindle chamber 14 and the pressure chamber 17 are again filled with hydraulic medium until there prevails approximately an equal pressure on both sides of the actuating piston 5. The closing spring 6 now displaces the actuating piston 5 towards the valve seat 27 and at the same time, through the piston 5, exerts a closing force on the valve disc 7.

It is thus seen that when the actuating piston is in its lower, advanced position as shown in FIG. 1, the valve disc 7 is no longer freely mechanically movable (as it is the case when the actuating piston 5 is in its upper, withdrawn position), but is maintained in its closed position as a result of the downwardly-directed force exerted by the base of the socket 19 on the terminus of the valve stem 28.

Thus, the valve assembly functions simultaneously as an excess pressure safety valve for that housing portion of the steam turbine to which the tap or extraction conduit is joined.

Turning now to FIG. 2, there is illustrated a modified valve construction. It differs from the embodiment illustrated in FIG. 1 in that the hydraulic medium for filling the spindle chamber 14 and the pressure chamber 17 to thus exert a force on the actuating piston 5 is taken through a channel 25 from the inlet side of the valve assembly, that is, from the upstream housing chamber 33 oriented towards the turbine. Further, the actuating piston is sealed by piston rings 30 towards the guide cylinder 20.

In this manner the rapid shutoff valve, by virtue of proper control, can take over simultaneously the function of the shutoff valve in case disturbances at the consumer side require a temporary shutoff of the valve.

It will be understood that the above description of the present invention is susceptible to various modifications, changes and adaptations and the same are intended to be comprehended within the meaning and range of equivalents of the appended claims.

What is claimed is:

1. A rapid shutoff extraction check valve comprising in combination:

a. a valve housing;

b. means defining a main inlet in said valve housing;

c. means defining a main outlet in said valve housing;

d. means defining a valve seat in said valve housing between said main inlet and said main outlet; said valve seat dividing the inner space of said valve housing into an upstream housing chamber continuously communicating with said main inlet and a downstream housing chamber continuously communicating with said main outlet;

e. a guide cylinder supported in said valve housing and defining a pressure chamber;

f. an actuating piston slidably received in said guide cylinder and bounding said pressure chamber; said actuating piston having an outer piston face operatively exposed to pressure prevailing in said downstream housing chamber; said actuating piston having a withdrawn position and an advanced position;

g. a movable valve body held in said actuating piston by a support means; said support means providing for a mechanically free movement of said movable valve body into a closed position in which it engages said valve seat for blocking communication between said main inlet and said main outlet and into an open position in which it is spaced from said valve seat for maintaining communication between said main inlet and said main outlet; said mechanically free movement of said movable valve body being relative to said actuating piston and being provided solely in said withdrawn position of said actuating piston;

h. means defining a discharge outlet in said valve housing;

i. first channel means connecting one of said housing chambers with said discharge outlet;

j. second channel means connecting said pressure chamber with said discharge outlet and with said one housing chamber through said first channel means; and k. auxiliary valve means having a first position in which it maintains communication, through said first and second channel means, between said one housing chamber and said pressure chamber and blocks communication between said pressure chamber and said discharge outlet; said auxiliary valve means having a second position in which it maintains communication, through said second channel means, between said pressure chamber and said discharge outlet and blocks communication between said one housing chamber and said pressure chamber;

l. means for moving said actuating piston from said withdrawn position into said advanced position solely in said first position of said auxiliary valve means; and m. means provided on said actuating piston for moving said valve body into said closed position upon movement of said actuating piston into said advanced position and for maintaining said valve body in said closed position as long as said actuating piston is maintained in said advanced position.

2. A rapid shutoff extraction check valve as defined in claim 1, further comprising a throttle arranged in said second channel means for restricting the flow passage thereof.

3. A rapid shutoff extraction valve as defined in claim 2, wherein said throttle is adjustable.

4. A rapid shutoff extraction check valve as defined in claim 1, wherein said movable valve body includes a valve disc cooperating with said valve seat and a valve stem affixed to said valve disc; further comprising means defining an outwardly open socket in said actuating piston for freely slidably receiving said valve stem.

5. A rapid shutoff extraction check valve as defined in claim 1, wherein said pressure chamber has a wall provided wih an annular abutment for sealingly engaging a cooperating annular face of said actuating piston in said withdrawn position when said auxiliary valve is in said second position.

6. A rapid shutoff extraction check valve as defined in claim 1, wherein said one housing chamber is said downstream housing chamber.

7. A rapid shutoff extraction check valve as defined in claim 1, wherein said one housing chamber is said upstream housing chamber.

8. A rapid shut off extraction check valve as defined in claim 1, further comprising a compression spring disposed in said pressure chamber for urging said actuating piston outwardly from said pressure chamber; said compression spring forming part of said means for moving said actuating piston into said advanced position.

* * * * *